US011231192B1

(12) United States Patent
Shah

(10) Patent No.: US 11,231,192 B1
(45) Date of Patent: Jan. 25, 2022

(54) COOLING AND HEATING METHODOLOGY AND SYSTEMS

(71) Applicant: Varun A. Shah, Los Altos Hills, CA (US)

(72) Inventor: Varun A. Shah, Los Altos Hills, CA (US)

( * ) Notice: Subject to any disclaimer, the term of this patent is extended or adjusted under 35 U.S.C. 154(b) by 0 days.

(21) Appl. No.: 17/329,826

(22) Filed: May 25, 2021

Related U.S. Application Data

(60) Provisional application No. 63/085,888, filed on Sep. 30, 2020.

(51) Int. Cl.
*F24F 11/00* (2018.01)

(52) U.S. Cl.
CPC ... *F24F 11/0001* (2013.01); *F24F 2011/0002* (2013.01)

(58) Field of Classification Search
CPC ..... F24F 11/0001; F24F 2011/0002; F24F 2011/0004; F24F 2011/0005; F24F 2011/0006
See application file for complete search history.

(56) References Cited

U.S. PATENT DOCUMENTS 5,000,381 A * 3/1991 Mueller ..... F24F 7/013 165/291
10,001,288 B1 * 6/2018 Yang ..... F24F 11/0001
2006/0199513 A1 * 9/2006 Choi ..... F24F 11/0001 454/237
2007/0057078 A1 * 3/2007 Martin ..... F24F 3/0442 236/49.3
2009/0013703 A1 * 1/2009 Werner ..... F24F 5/0046 62/180

(Continued)

FOREIGN PATENT DOCUMENTS

CN 108266851 A * 7/2018
CN 108844197 A * 11/2018

(Continued)

OTHER PUBLICATIONS

"ACK42 Chain Actuator 230v or 24v," Rocbum Limited, retrieved https://www.window-openers.com/ack4-electric-chain-actuator/, retrieved on May 26, 2021, p. 3.

(Continued)

*Primary Examiner* — Nelson J Nieves
(74) *Attorney, Agent, or Firm* — Invoke

(57) ABSTRACT

Techniques for heating and/or cooling a structure including are described. The system may determine that a current indoor temperature is higher than both the current outdoor temperature and the target indoor temperature. Based on the determination, the system (in a cooling mode) may determine that a window opening criteria is met for opening one or more windows. Responsive to determining that the window opening criteria has been met, the system may instruct a window control mechanism to modify a state of the window from (a) a closed position that prevents airflow through the window to (b) an open position that allows for airflow through the window to cool a structure. Similarly, the system in a heating mode may open one or more windows when the current indoor temperature is lower than both the target indoor temperature and the current outdoor temperature.

19 Claims, 8 Drawing Sheets

(56) References Cited

U.S. PATENT DOCUMENTS

| | | | | |
|---|---|---|---|---|
| 2015/0184884 | A1* | 7/2015 | Aquino | F24F 11/76 165/250 |
| 2015/0300677 | A1* | 10/2015 | Wang | E06B 7/02 96/384 |
| 2016/0054017 | A1* | 2/2016 | Takahashi | F24F 11/30 700/276 |
| 2016/0069579 | A1* | 3/2016 | Yabunouchi | F24F 11/62 165/11.2 |
| 2019/0107307 | A1* | 4/2019 | Kring | F24F 13/105 |
| 2019/0162009 | A1* | 5/2019 | Hall | E05F 15/77 |
| 2019/0309559 | A1* | 10/2019 | Hall | E05F 15/71 |
| 2019/0383505 | A1* | 12/2019 | Kim | F24F 13/24 |
| 2020/0018497 | A1* | 1/2020 | Aquino | F24F 5/0035 |
| 2020/0018499 | A1* | 1/2020 | Aquino | F24F 11/0001 |
| 2020/0141608 | A1* | 5/2020 | Sinha | F24F 13/28 |
| 2020/0206675 | A1* | 7/2020 | Kim | F24F 11/0001 |
| 2021/0156582 | A1* | 5/2021 | Stevenson | F24F 7/007 |
| 2021/0256639 | A1* | 8/2021 | Ladd | G06Q 50/163 |

FOREIGN PATENT DOCUMENTS

| | | | | | |
|---|---|---|---|---|---|
| CN | 109631241 | A | * | 4/2019 | |
| CN | 109631265 | A | * | 4/2019 | |
| CN | 111059720 | A | * | 4/2020 | |
| WO | WO-2009058127 | A1 | * | 5/2009 | F24F 11/30 |
| WO | WO-2013113987 | A1 | * | 8/2013 | E06B 7/084 |

OTHER PUBLICATIONS

"Electroc Window Openers," Roebum Limited, https://www.window-openers.com/electric-window-openers/, retrieved on May 26, 2021, p. 7.

"Window Actuators," Rocburn Limited, retrieved https://www.window-openers.com/linear-window-actuators/, retrieved on May 26, 2021, p. 3.

* cited by examiner

COOLING AND HEATING METHODOLOGY AND SYSTEMS

INCORPORATION BY REFERENCE

This application is hereby incorporated by reference: application No. 63/085,888 filed on Sep. 30, 2020. The Applicant hereby rescinds any disclaimer of claim scope in the parent application or the prosecution history thereof and advises the USPTO that the claims in this application may be broader than any claim in the parent application.

The Appendix A, Appendix B, and Appendix C as filed herewith are incorporated by reference.

TECHNICAL FIELD

The present disclosure relates to controlling openings within a wall or roof of a building based on current indoor temperature, target indoor temperature and/or outdoor temperature.

BACKGROUND

A window, as referred to herein, is an opening in a wall, door, or roof. Some windows may be configurable in exactly two positions: an open position and a closed position. Other windows may be configurable in multiple different open positions (degrees of open) and a closed position. Generally, a window in a closed position prevents the flow of air through the window. In contrast, a window in an open position allows for the flow of air through the window. Windows that allow for various open positions, allow for different rates of air flow through the window. As should be understood by those skilled in the art, in addition to the particular open position, the actual rate of airflow may be based on wind speed.

Windows may be opened and closed using electric actuators/window openers such as those manufactured by Nekos, TOPP, Ultraflex Control Systems (UCS), Aprimatic, Window Master, D&H, Aumuller, Mingardi, AXA, and Solar Breeze.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

BRIEF DESCRIPTION OF THE DRAWINGS

The embodiments are illustrated by way of example and not by way of limitation in the figures of the accompanying drawings. It should be noted that references to "an" or "one" embodiment in this disclosure are not necessarily to the same embodiment, and they mean at least one. In the drawings.

DETAILED DESCRIPTION

Figure 1A:
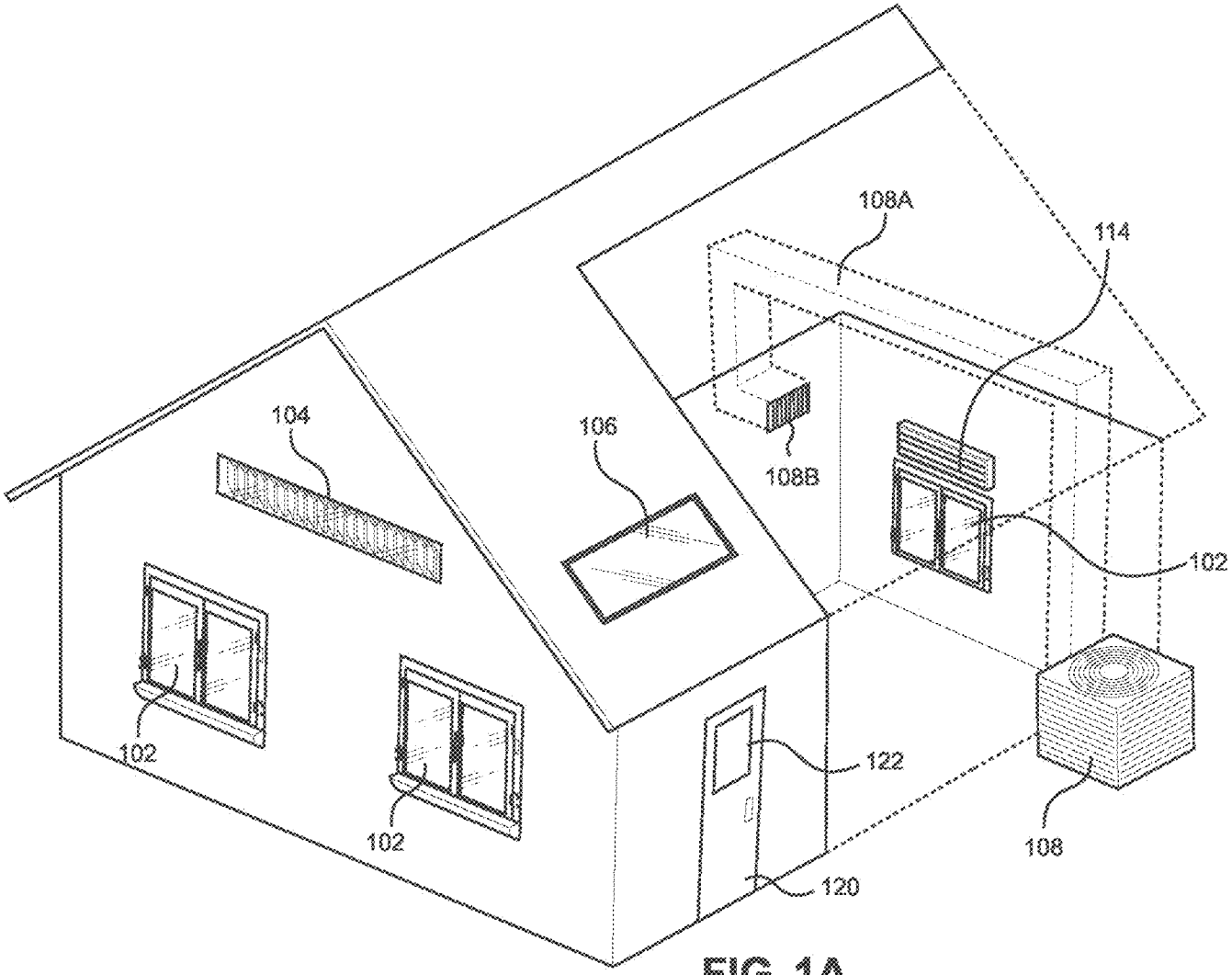
FIG. 1A shows a structure including windows in accordance with one or more embodiments.

In the following description, for the purposes of explanation, numerous specific details are set forth in order to provide a thorough understanding. One or more embodiments may be practiced without these specific details. Features described in one embodiment may be combined with features described in a different embodiment. In some examples, well-known structures and devices are described with reference to a block diagram form in order to avoid unnecessarily obscuring the present invention.

1. GENERAL OVERVIEW
2. STRUCTURE INCLUDING A WINDOW FOR HEATING AND COOLING
3. ARCHITECTURAL OVERVIEW
4. CONTROLLING A WINDOW CONFIGURATION
   - 4.1 TEMPERATURE BASED WINDOW CONFIGURATION
   - 4.2 SELECTING A HC SYSTEM BASED ON A TEMPERATURE DIFFERENTIAL
   - 4.3 CONTROLLING VENTILATION BASED ON WINDOW POSITION
   - 4.4 CONTROLLING A WINDOW STATE BASED ON TEMPERATURE FORECASTING
5. MISCELLANEOUS; EXTENSIONS
6. HARDWARE OVERVIEW

1. General Overview

One or more embodiments control the opening or closing of a window. In particular, a system switches a state/position of a window between a closed position (e.g., a position that completely or substantially blocks airflow through the window) and an open position (e.g., a position that allows for airflow through the window) based on one or more of: a current outdoor temperature, a current indoor temperature, or a target indoor temperature.

The current outdoor temperature may be detected periodically or continuously via a sensor positioned outside the structure. The current outdoor temperature may be obtained from a third party (e.g., the national weather service) based on a location (e.g., city or zip code) of the structure. The current outdoor temperature may be determined based on a data set noting the predicted temperature at various times. As an example, the system may obtain a schedule indicating the predicted temperature at a location at each hour of the day.

The current indoor temperature may be detected periodically or continuously via a sensor positioned inside the structure. The target indoor temperature may be received via user input or selected by the system via a machine learning model that is trained on prior selections of target indoor temperature.

In an embodiment, a Heating Cooling (HC) system operates in a cooling mode by cooling the structure using airflow through windows. When the system is configured in a cooling mode, the system may cool the structure by opening a window when the system detects that a current indoor temperature of the structure is higher than a current outdoor temperature. The system (in cooling mode) may be configured to subsequently close the window when the current indoor temperature matches the current outdoor temperature. Alternatively, or in addition, the system (in cooling mode) may be configured to subsequently close the window when the current indoor temperature is lower than the current outdoor temperature.

When the HC system is configured in a heating mode, the system may heat the structure by opening a window when the system detects that a current indoor temperature of the structure is lower than a current outdoor temperature. The system (in heating mode) may be configured to subsequently close the window when the current indoor temperature matches the current outdoor temperature. Alternatively, or in addition, the system (in heating mode) may be configured to subsequently close the window when the current indoor temperature is higher than the current outdoor temperature.

In another embodiment, a system operating in a cooling mode may cool a structure by opening a window when the system detects that a current indoor temperature of the structure is higher than both the current outdoor temperature and a target indoor temperature. In an example, a system configured in a cooling mode determines that the current indoor temperature is 76 degrees Fahrenheit, the target indoor temperature is 68 degrees Fahrenheit, and the outdoor temperature is 74 degrees Fahrenheit. Responsive to determining that the current indoor temperature is higher than both the current outdoor temperature and the target indoor temperature, the system (in cooling mode) modifies a state of a window from a closed position to an open position. The open position allows the outdoor air to flow from outside the structure to inside the structure through the window. As a result, the house is cooled naturally via the windows. The system (in cooling mode) may be configured to close the window when either (a) the current indoor temperature is no longer higher than the target indoor temperature or (b) the current indoor temperature is lower than the current outdoor temperature.

The system operating in a heating mode may heat a structure by opening a window when the system detects that a current indoor temperature of the structure is lower than both the current outdoor temperature and a target indoor temperature. In an example, a system configured in a heating mode determines that the current indoor temperature is 66 degrees Fahrenheit, the target indoor temperature is 72 degrees Fahrenheit, and the outdoor temperature is 72 degrees Fahrenheit. Responsive to determining that the current indoor temperature is lower than both the current outdoor temperature and the target indoor temperature, the system (in cooling mode) modifies a state of a window from a closed position to an open position. The open position allows the outdoor air to flow from outside the structure to inside the structure through the window. As a result, the house is heated naturally via the windows. The system (in heating mode) may be configured to close the window when either (a) the current indoor temperature is no longer lower than the target indoor temperature or (b) the current indoor temperature is higher than the current outdoor temperature.

In an embodiment, a target indoor temperature, defined for a system in cooling mode, corresponds to the lowest temperature that is tolerable to a user. A user may cool a home, using no-cost airflow through the windows, to the lowest tolerable temperature (e.g., 60°) that is lower than the user's ideal temperature (e.g., 70°) so that when the temperature increases, the home stays cool for a longer period of time. In an example, the outdoor temperature varies from a high of 80° F. during the daytime to a low of 50° F. overnight. A user may set the system in cooling mode with target indoor temperature of 60° F. 60° F. is the lowest temperature in the user's preferred temperature range for the inside of the user's home. The system cools the structure down by maintaining the windows in an open state when the current indoor temperature is both (a) higher than the target indoor temperature of 60° F. and (b) higher than a current outdoor temperature. Initially, the outdoor temperature may be 80° and the indoor temperature may be 72°. As the temperature cools down in the evening, the system detects when the outdoor temperature drops below the current indoor temperature of 72° F. When the system detects that the current indoor temperature of 72° F. is higher than the current outdoor temperature and also higher than the target indoor temperature of 60° F., the system opens the windows to allow the house to naturally cool via airflow through the windows. The house may continue to cool naturally as the outdoor temperature continues to drop through the evening/night. Once the current indoor temperature reaches 60° F., the lowest tolerable by the user, the system closes the windows. Closing the windows prevents the house from further cooling via air flow through the windows. However, it should be understood that the house may be further cooled lower than 60° F. even though the windows are closed due to other factors such as faulty seals, natural cooling through walls, etc. In some embodiments, the system may learn through a machine learning model that the house will likely be cooled an additional two degrees subsequent to closing the windows through other cooling when the outside temperature is 50° F. Based on the expected additional cooling of 2° F., the system may close the windows when the current indoor temperatures reaches 62°.

The target indoor temperature, defined for a system in heating mode, may correspond to the highest temperature that is tolerable to a user. In an example, the outdoor temperature varies from a high of 80° F. during the daytime to a low of 45° F. overnight. A user may set the system in heating mode with target indoor temperature of 75° F. 75° F. is the highest temperature in the user's preferred temperature range for the inside of the user's home. The system heats the structure down by opening windows when the current indoor temperature is (a) lower than the target indoor temperature of 75° F. and (b) lower than a current outdoor temperature. As the temperature goes up in the daytime, the system detects that the outdoor temperature is higher than the current indoor temperature of 65° F. When the system detects that the current indoor temperature of 65° F. is lower than the current outdoor temperature and also lower than the target indoor temperature of 75° F., the system opens the windows to allow the house to naturally heat via the airflow through the windows. Once the current indoor temperature reaches 75° F., the highest tolerable by the user, the system closes the window. Closing the windows prevents the house from further heating via air flow through the windows.

In an embodiment, the HC system selects one of a window-based HC subsystem or a ducts-based HC subsystem to heat or cool the structure. A ducts-based HC subsystem, as referred to herein, heats or cools a structure by blowing hot or cold air into a structure through ducts. A ducts-based subsystem is also commonly referred to as central cooling system and/or central heating system. A ducts-based HC system typically includes (a) an appliance (such as 108 in FIG. 1A) that warms or cools air, and one or more ducts (e.g., 108A in FIG. 1A) that is used to blow air from the appliance into the structure.

In an embodiment, the HC system may be configured to prioritize the window-based subsystem over a ducts-based HC subsystem to heat or cool a structure. Prioritizing the window-based HC system over the ducts-based subsystem includes (a) selecting the window-based system when opening windows would be result in the current indoor temperature reaching the target indoor temperature, and (b) selecting the ducts-based subsystem when opening windows would not result in the current indoor temperature reaching the target indoor temperature.

In an embodiment, a threshold difference in temperature between a current indoor temperature and a current outdoor temperature is used to determine whether to use the window-based subsystem or the ducts-based subsystem. As an example, the window-based system would be selected for cooling a structure as long as the current outdoor temperature is at least five degrees lower than the current indoor temperature. If the current outdoor temperature is not at least five degrees lower than the current indoor temperature, then a ducts-based HC subsystem may be selected for cooling the structure.

While a window-based subsystem may cool a structure when the outdoor temperature is only one degree cooler than a current indoor temperature, cooling may take too long, or otherwise be deemed ineffective. Accordingly, a threshold difference in temperature is used to ensure effective cooling, or cooling within a reasonable amount of time.

In another example, a window-based subsystem would be selected for heating the structure as long as the current outdoor temperature is at least three degrees higher than the current indoor temperature. If the current outdoor temperature is not at least three degrees higher than the current indoor temperature, then a ducts-based HC subsystem may be selected for heating the structure.

In an embodiment, the HC system uses a combination of a window-based subsystem and a ducts-based subsystem to cool or heat a structure. The HC system may use the window-based subsystem and the ducts-based subsystem concurrently at the same time, or during separate respective time intervals. The HC system may initially use the window-based subsystem by opening the windows to allow natural cooling, and later, close the windows and use the ducts-based subsystem. In an example, a current indoor temperature is 85° F., a current outdoor temperature is 75° F., and a target indoor temperature is 68° F. When the HC system is activated in a cooling mode, the HC system determines that the window-based subsystem would be effective in lowering the current indoor temperature. Accordingly, the HC system opens the windows to allow cooler outside air to flow into the structure. Additionally, opening the windows allows hot inside air to flow out of the structure. After a certain period of time, the HC system determines that both the current indoor temperature and the current outdoor temperature are at 74° F. However, the target indoor temperature is still at 68° F. Determining that the window-based subsystem can no longer cool the current indoor temperature from 74° F. to the target indoor temperature of 68° F., the HC system closes the windows, and activates the ducts-based HC subsystem. The ducts-based HC subsystem then blows cool air through the structure until the current indoor temperature reaches 68° F. The HC system may also transition from using the window-based subsystem to the duct-based subsystem when the current indoor temperature is within a threshold distance of the current outdoor temperature (e.g., difference is less than or equal to 3° F.). The HC system transitions from the window-based subsystem to the ducts-based subsystem based on the current effectiveness of the window-based subsystem to modify the current indoor temperature to reach the target indoor temperature.

A ducts-based subsystem typically costs money for operating the appliance that cools or heats air. In contrast, a window-based system cools/heats a structure through natural air and therefore costs less money to operate than a ducts-based subsystem. In an embodiment, the system includes functionality to operate both the window-based subsystem and the ducts-based subsystem using different target temperatures (possibly preferred by users due to the difference in cost). The system in a cooling mode may be configured, for example, with (a) a lowest tolerable temperature as a target temperature for cooling by a window-based subsystem and (b) a highest tolerable temperature as a target temperature for cooling by a ducts-based subsystem. As an example, when the system is configured in a cooling mode, the window-based subsystem may be configured with a target temperature of 60° and the ducts-based subsystem may be configured with a target temperature of 72°. During the daytime when the outdoor temperature is higher than the indoor temperature, the ducts-based subsystem may cool the home to 72° and turn off once 72° is reached. The window-based subsystem may maintain the windows in a closed state to avoid hot air from outside coming into the structure and heating up the structure. During the evening/night when the outdoor temperature drops below the current indoor temperature, the window-based subsystem may cool the structure by maintaining the windows in an open state until the current indoor temperature is cooled down to 60°. As noted above, the ducts-based subsystem may be turned off once a structure is cooled to 72°. The ducts-based subsystem may be turned off prior to then (e.g., when the structure is still at 75° if the window-based subsystem can cool the structure (i.e., system determines that outdoor temperature is lower than indoor temperature).

Alternatively, the system may cool the structure using both the ducts-based subsystem and the window-based subsystem when the current indoor temperature is higher than (a) the current outdoor temperature, (b) the target temperature set for the window-based subsystem and (c) the target temperature set for the ducts-based subsystem.

In an embodiment, the HC system opens and/or closes windows of a windows-based HC subsystem based on a predicted temperature values. When the HC system is configured in a cooling mode, the HC system opens windows when (a) the current outdoor temperature is lower than the current indoor temperature and (b) the current outdoor temperature is predicted to drop for the near-term future (e.g., predicted to drop for at least the next two hours). When the HC system is configured in a heating mode, the HC system opens the windows when the (a) the current outdoor temperature is higher than the current indoor temperature and (b) the current outdoor temperature is predicted to increase in the near-term future (e.g., predicted to increase for at least the next sixty minutes).

While various embodiments/examples described herein refer to a cooling mode or a heating mode, it should be understood that the HC system may be configured in a dual heating-cooling mode that is defined by a temperature range and involves combinations of operations described herein. As an example, the dual heating-cooling mode may be configured with a target indoor temperature range of 68° F. to 74° F. Operations for cooling a structure may be executed when the current indoor temperature exceeds 74° F. and operations for heating the structure may be executed when the current indoor temperature falls below 68° F.

In an embodiment, windows-based HC subsystem may be implemented with fans that increase the flow of air into the structure or out of the structure. Specifically, the system may be configured such that a fan(s), that is positioned to blow air through a window, is activated whenever the window is open and deactivated whenever the window is closed. The fan may be positioned within a frame of the window or within a close proximity of the window for increased effectiveness.

One or more embodiments described in this Specification and/or recited in the claims may not be included in this General Overview section.

2. Structure Including a Window for Heating and Cooling

FIGS. 1A-1E illustrate aspects of a structure 100. The structure 100 may include more or fewer components than the components illustrated in FIG. 1. In embodiments, operations described with respect to one component may instead be performed by another component.

FIG. 1A illustrates the structure 100 disposed at a location. The structure 100 may be any structure for which an owner or user desires to control the climate using a window-based HC system alone, or in combination with a ducts-based HC system. The window-based HC system and the ducts-based HC system may be referred to herein as a window-based HC subsystem and ducts-based HC subsystem, respectively.

The structure 100 may be, for example, a single-family home, a duplex, a townhome or row home, one or more apartments or condominiums, an office building, or a warehouse. There are many types of structure to which the heating and cooling methodologies may be applied. In embodiments, the structure 100 includes one or more windows 102 mounted in a structure wall. For example, the windows 102 may include casement windows, awning windows, sash windows, and/or louvered windows. In embodiments the structure 100 includes one or more windows 106 mounted in a ceiling of the structure. In some embodiments, the structure 100 includes one or more windows 104 disposed in a structure wall. The windows 104 may be windows having a dimension and/or position that prevent a human from entering or exiting the structure via window 104. Windows, opened and/or closed by the system, may be configured to prevent a human from entering or exiting the structure to prevent burglary, etc. Any type of windows may be integrated into the window-based HC system described herein.

The structure 100 may include a centralized, duct-based HC system 108. The duct-based HC system 108 may include one or more of a heat pump, an air conditioner, a furnace, and/or a centralized fan. One or more ducts 108*a* are used as conduits or passages for delivery and/or removal of air from the interior of the structure to the system 108. The ducts 108*a* of the duct-based HC system 108 may include one or more vents for controlling and/or directing passage of air from the duct to the structure interior.

The structure 100 may include a localized HC system 114, such as a fan mounted or otherwise disposed near at least one window (e.g., a window 102) to encourage airflow through the window. The localized HC system 114 may include, for example, an axial or propeller-style fan, a centrifugal fan, a cross-flow fan, and/or a Coanda effect fan. Many different fan types may be integrated into the localized HC system.

Figure 1B:
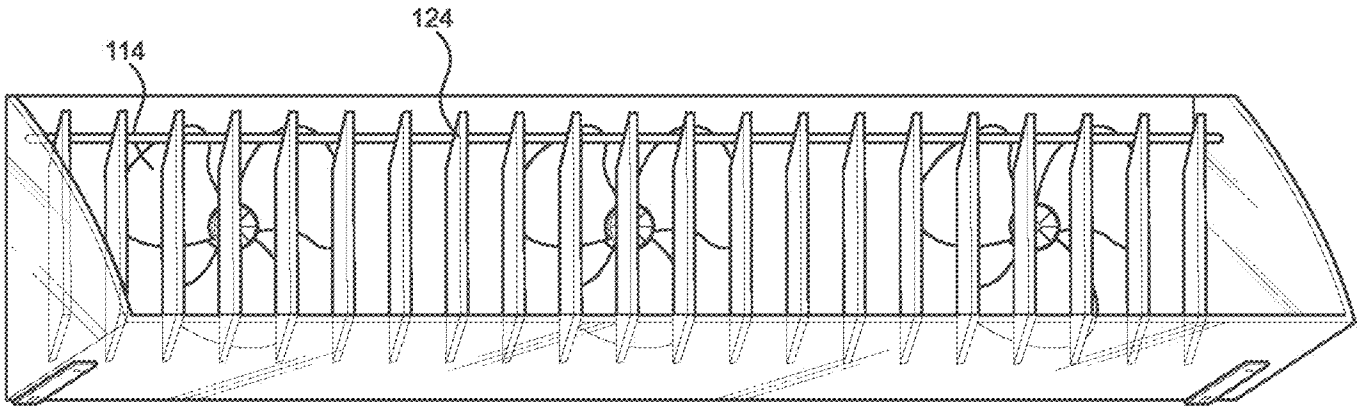
FIG. 1B shows a detail view of a window in accordance with one or more embodiments.

FIG. 1B shows a detailed view of window 106. The window 106 includes members 124 that are movable to modify a state of window 106 between a closed position that blocks airflow through the window and an open position that allows airflow through the window. The members 124 may be made from any transparent material, such as glass, plastic, or plexiglass (e.g., polymethyl methacrylate), a translucent material, or an opaque material. The members 124 may be electrically, hydraulically, or pneumatically actuated.

The window 106 may include a localized HC system 114, such as a fan(s) for encouraging airflow through the window 106. In embodiments, the localized HC system 114 may be configurable to encourage airflow in a particular direction (e.g., either from exterior to interior, or from interior to exterior).

Figure 1C:
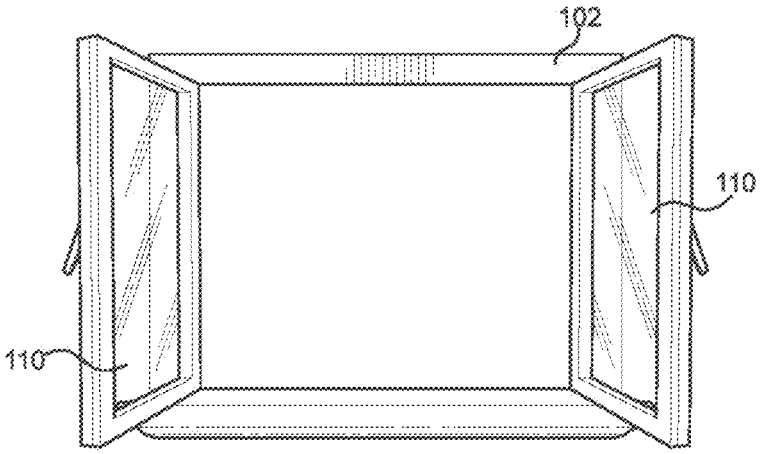
FIG. 1C shows a window in an open state in accordance with one or more embodiments.
Figure 1D:
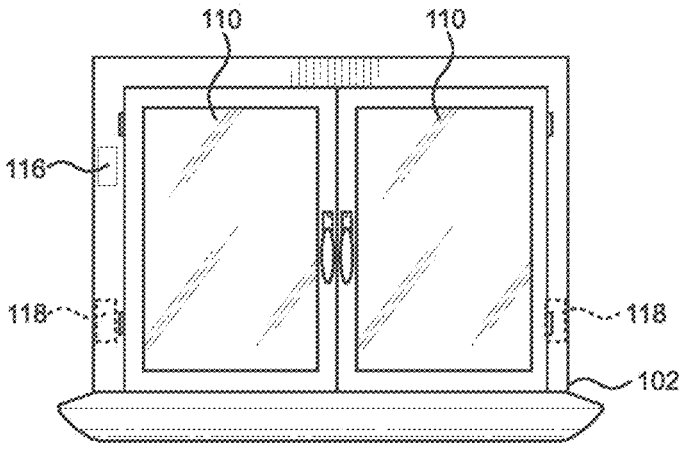
FIG. 1D shows a window in a closed state in accordance with one or more embodiments.
Figure 1E:
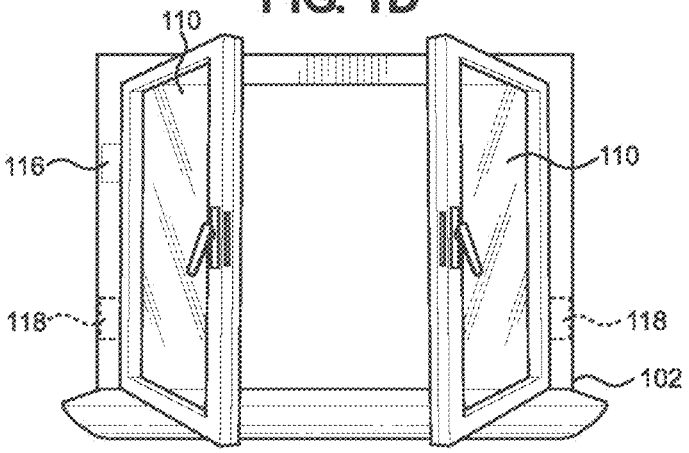
FIG. 1E shows a window in an open state in accordance with one or more embodiments.

FIGS. 1C-1E illustrate a window 102 in various configurations. The window 102 includes a sensor 116 for sensing weather characteristics at an exterior of the window. In embodiments, the sensor 102 may include one or more of a thermometer, an anemometer, a hygrometer, rain gauge, and/or an air quality sensor. Many sensors may be used to measure various weather characteristics at a location of the window.

In embodiments, the window 102 may include a motor or other actuator for causing the window to move between the closed configuration that limits airflow through the window and the open configuration which allows airflow through the window. Electric actuators/window openers known today or developed in the future may be used by the HC system to open/close windows based on an analysis of current indoor temperature, target indoor temperature and/or current outdoor temperature. Electric actuators/window openers open or close a window by applying an electrical signal which operates any mechanisms that open and close windows. In an example, a chain may be moved using an electrical signal applied to a gear. The movement of the chain may increase or decrease the size of an opening in the window.

FIG. 1C shows a window 102 in a closed configuration. That is, as shown in FIG. 1C, the window 102 is configured such that transparent members 110 block airflow through the window.

FIG. 1D shows the window 102 in a partially open configuration. That is, as shown in 1D, the transparent members 110 provide relatively less resistance to airflow through the window, as compared to the closed configuration. In embodiments, the airflow permitted through the window may be proportional to a degree of openness of the window 102. For example, a 60% degree of openness may correspond to allowing 60% airflow through the window, relative to a window in the open configuration.

FIG. 1E shows the window 102 in an open configuration. That is, as shown in FIG. 1E, the transparent members 110 provide minimal resistance to airflow through the window.

3. Architectural Overview

Figure 2:
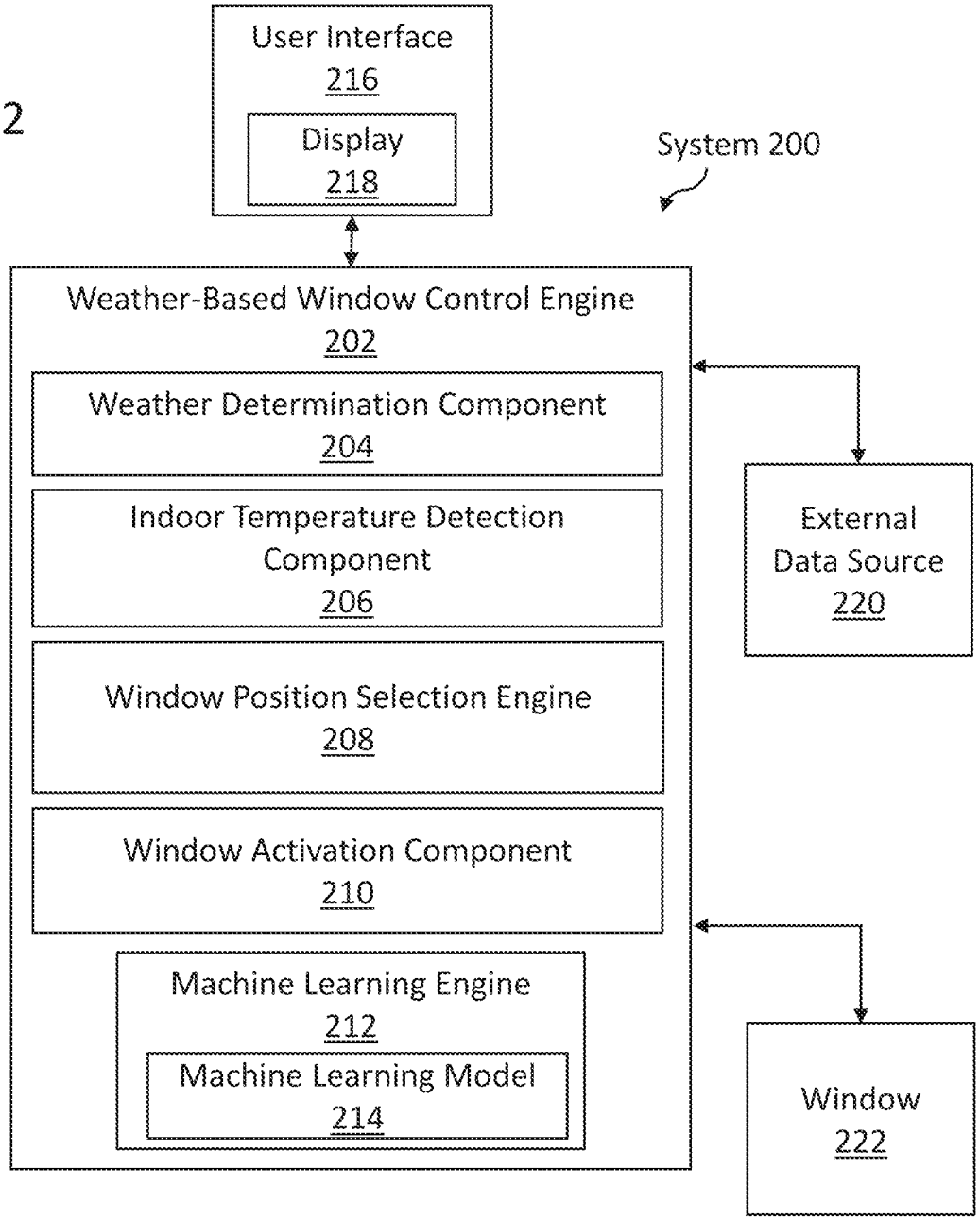
FIG. 2 illustrates a system for cooling and/or heating a structure including a window, in accordance with one or more embodiments.

FIG. 2 illustrates a system 200 in accordance with one or more embodiments. As illustrated in FIG. 2, system 200 includes a weather-based window control engine 202, a user interface 216, an external data source 220, a window 222, and various components thereof for implementing heating and/or cooling methods at the interior of a structure. The system 200 may include more or fewer components than the components illustrated in FIG. 2. The components illustrated in FIG. 2 may be local to or remote from each other. The components illustrated in FIG. 2 may be implemented in software and/or hardware. Each component may be distributed over multiple applications and/or machines. Multiple components may be combined into one application and/or machine. Operations described with respect to one component may instead be performed by another component.

In one or more embodiments, the user interface 216 refers to hardware and/or software configured to facilitate communications between a user and the weather-based window control engine 202. The user interface 216 may be used by a user who accesses an interface (e.g., a dashboard interface) for climate control purposes. The user interface 216 may be associated with one or more devices for presenting visual media, such as a display 218, including a monitor, a television, a projector, and/or the like. User interface 216 renders user interface elements and receives input via user interface elements. Examples of interfaces include a graphical user interface (GUI), a command line interface (CLI), a haptic interface, and a voice command interface. Examples of user interface elements include checkboxes, radio buttons, menus, dropdown lists, list boxes, buttons, toggles, text fields, date and time selectors, command lines, sliders, pages, and forms. As a particular example, the system 200 may receive, via the user interface 216, a target indoor temperature. The target indoor temperature may specify a particular temperature at which the user would like the interior of the structure. The weather based window control engine 202 may be used to work towards maintaining the specified target indoor temperature.

In an embodiment, different components of the user interface 216 are specified in different languages. The behavior of user interface elements is specified in a dynamic programming language, such as JavaScript. The content of user interface elements is specified in a markup language, such as hypertext markup language (HTML) or XML User Interface Language (XUL). The layout of user interface elements is specified in a style sheet language, such as Cascading Style Sheets (CSS). Alternatively, the user interface 216 is specified in one or more other languages, such as Java, C, or C++.

In one or more embodiments, a weather-based window control engine 202 refers to hardware and/or software configured to perform operations described herein for selecting query results to display to a user. Examples of operations for selecting query results to display to a user are described below with reference to FIGS. 3-5.

In an embodiment, the weather-based window control engine 202 includes a weather determination component 204. A weather determination component 204 may refer to hardware and/or software configured to perform operations described herein (including such operations as may be incorporated by reference) for detecting one or more outdoor weather conditions at a particular time.

In an embodiment, the weather-based window control engine 202 includes an indoor temperature detection component 206. An indoor temperature detection component 206 may refer to hardware and/or software configured to detect an indoor temperature at a particular time (e.g., a current indoor temperature).

In an embodiment, the weather-based window control engine 202 includes a window position selection engine 208. A window position selection engine 208 may refer to hardware and/or software configured to determine if at least the detected outdoor weather conditions and the detected current indoor temperature satisfy one or more opening criteria and/or one or more closing criteria, and selecting a window open position.

In an embodiment, the weather-based window control engine 202 includes a window activation component 210. A window activation component 210 may refer to hardware and/or software configured to cause a window 222 to be configured to the selected window open position.

In an embodiment, one or more components of the weather-based window control engine 202 use a machine learning engine 212. In particular, the machine learning engine 112 may be used when selecting a window open position (e.g., by the window position selection engine 208). Machine learning includes various techniques in the field of artificial intelligence that deal with computer-implemented, user-independent processes for solving problems that have variable inputs.

In some embodiments, the machine learning engine 212 trains a machine learning model 214 to perform one or more operations. Training a machine learning model 214 uses training data to generate a function that, given one or more inputs to the machine learning model 214, computes a corresponding output. The output may correspond to a prediction based on prior machine learning. In an embodiment, the output includes a label, classification, and/or categorization assigned to the provided input(s). The machine learning model 214 corresponds to a learned model for performing the desired operation(s) (e.g., labeling, classifying, and/or categorizing inputs). A weather-based window control engine 202 may use multiple machine learning engines 212 and/or multiple machine learning models 214 for different purposes.

In an embodiment, the machine learning engine 212 may use supervised learning, semi-supervised learning, unsupervised learning, reinforcement learning, and/or another training method or combination thereof. In supervised learning, labeled training data includes input/output pairs in which each input is labeled with a desired output (e.g., a label, classification, and/or categorization), also referred to as a supervisory signal. In semi-supervised learning, some inputs are associated with supervisory signals and other inputs are not associated with supervisory signals. In unsupervised learning, the training data does not include supervisory signals. Reinforcement learning uses a feedback system in which the machine learning engine 212 receives positive and/or negative reinforcement in the process of attempting to solve a particular problem (e.g., to optimize performance in a particular scenario, according to one or more predefined performance criteria). In an embodiment, the machine learning engine 212 initially uses supervised learning to train the machine learning model 214 and then uses unsupervised learning to update the machine learning model 214 on an ongoing basis.

In an embodiment, a machine learning engine 212 may use many different techniques to label, classify, and/or categorize inputs. A machine learning engine 212 may transform inputs into feature vectors that describe one or more properties ("features") of the inputs. The machine learning engine 212 may label, classify, and/or categorize the inputs based on the feature vectors. For example, the machine learning engine 212 may receive, as inputs, at least the detected outdoor weather conditions the detected current indoor temperature, and the target indoor temperature input by the user, and transform these inputs to a feature vector. The machine learning engine 212 may categorize the feature vector based on the values of the inputs.

Alternatively or additionally, a machine learning engine 112 may use clustering (also referred to as cluster analysis) to identify commonalities in the inputs. The machine learning engine 112 may group (i.e., cluster) the inputs based on those commonalities. The machine learning engine 112 may use hierarchical clustering, k-means clustering, and/or another clustering method or combination thereof. For example, the machine learning engine 212 may receive, as inputs, at least the detected outdoor weather conditions the detected current indoor temperature, and the target indoor temperature input by the user, and may determine commonalities with previously-received inputs based on the received inputs. The machine learning engine may determine a window position based on determined window positions of the nearest neighbors of the received input.

In an embodiment, a machine learning engine 212 includes an artificial neural network. An artificial neural network includes multiple nodes (also referred to as artificial neurons) and edges between nodes. Edges may be associated with corresponding weights that represent the strengths of connections between nodes, which the machine learning engine 212 adjusts as machine learning proceeds. Alternatively or additionally, a machine learning engine 212 may include a support vector machine. A support vector machine represents inputs as vectors. The machine learning engine 212 may label, classify, and/or categorizes inputs based on the vectors. Alternatively or additionally, the machine learning engine 212 may use a naïve Bayes classifier to label, classify, and/or categorize inputs. Alternatively or additionally, given a particular input, a machine learning model may apply a decision tree to predict an output for the given input. Alternatively or additionally, a machine learning engine 212 may apply fuzzy logic in situations where labeling, classifying, and/or categorizing an input among a fixed set of mutually exclusive options is impossible or impractical. The aforementioned machine learning model 214 and techniques are discussed for exemplary purposes only and should not be construed as limiting one or more embodiments.

In an embodiment, as a machine learning engine 212 applies different inputs to a machine learning model 214, the corresponding outputs are not always accurate. As an example, the machine learning engine 212 may use supervised learning to train a machine learning model 214. After training the machine learning model 214, if a subsequent input is identical to an input that was included in labeled training data and the output is identical to the supervisory signal in the training data, then output is certain to be accurate. If an input is different from inputs that were included in labeled training data, then the machine learning engine 212 may generate a corresponding output that is inaccurate or of uncertain accuracy. In addition to producing a particular output for a given input, the machine learning engine 212 may be configured to produce an indicator representing a confidence (or lack thereof) in the accuracy of the output. A confidence indicator may include a numeric score, a Boolean value, and/or any other kind of indicator that corresponds to a confidence (or lack thereof) in the accuracy of the output.

In an embodiment, the weather-based window control engine 202 is configured to receive data from one or more external data sources 220. An external data source 220 refers to hardware and/or software operating independent of the weather-based window control engine 202. For example, the hardware and/or software of the external data source 220 may be under control of a different entity (e.g., a different company or other kind of organization) than an entity that controls the query suggestion engine. An external data source 220 may supply one or more weather characteristics associated with the location of the structure. An example of an external data source 220 supplying one or more weather characteristics may include a third party weather monitoring engine. Alternatively or additionally, an external data source may include a schedule for adjusting the target indoor temperature. An example, of an external data source 220 supplying the schedule for adjusting the target indoor temperature may include a database storing target indoor temperatures in association with one or more of a time of day and/or day of week. Many different kinds of external data sources 220 may supply many different kinds of data.

In an embodiment, weather-based window control engine 202 is configured to retrieve data from an external data source 220 by 'pulling' the data via an application programming interface (API) of the external data source 220, using user credentials that a user has provided for that particular external data source 220. Alternatively or additionally, an external data source 220 may be configured to 'push' data to the weather-based window control engine 202 via an API of the query suggestion service, using an access key, password, and/or other kind of credential that a user has supplied to the external data source 220. A weather-based window control engine 202 may be configured to receive data from an external data source 220 in many different ways.

In an embodiment, the system 200 is implemented on one or more digital devices. The term "digital device" generally refers to any hardware device that includes a processor. A digital device may refer to a physical device executing an application or a virtual machine. Examples of digital devices include a computer, a tablet, a laptop, a desktop, a netbook, a server, a web server, a network policy server, a proxy server, a generic machine, a function-specific hardware device, a hardware router, a hardware switch, a hardware firewall, a hardware firewall, a hardware network address translator (NAT), a hardware load balancer, a mainframe, a television, a content receiver, a set-top box, a printer, a mobile handset, a smartphone, a personal digital assistant ("PDA"), a wireless receiver and/or transmitter, a base station, a communication management device, a router, a switch, a controller, an access point, and/or a client device.

4. Controlling a Window Configuration

A window configuration may be controlled based on at least weather-related factors. In particular, a window configuration may be controlled based at least in part on an outdoor temperature at a particular time, an indoor temperature at the particular time (e.g., a current indoor temperature), and a target indoor temperature. There are several methods for configuring the window, as discussed below.

4.1 Temperature Based Window Configuration

Figure 3:
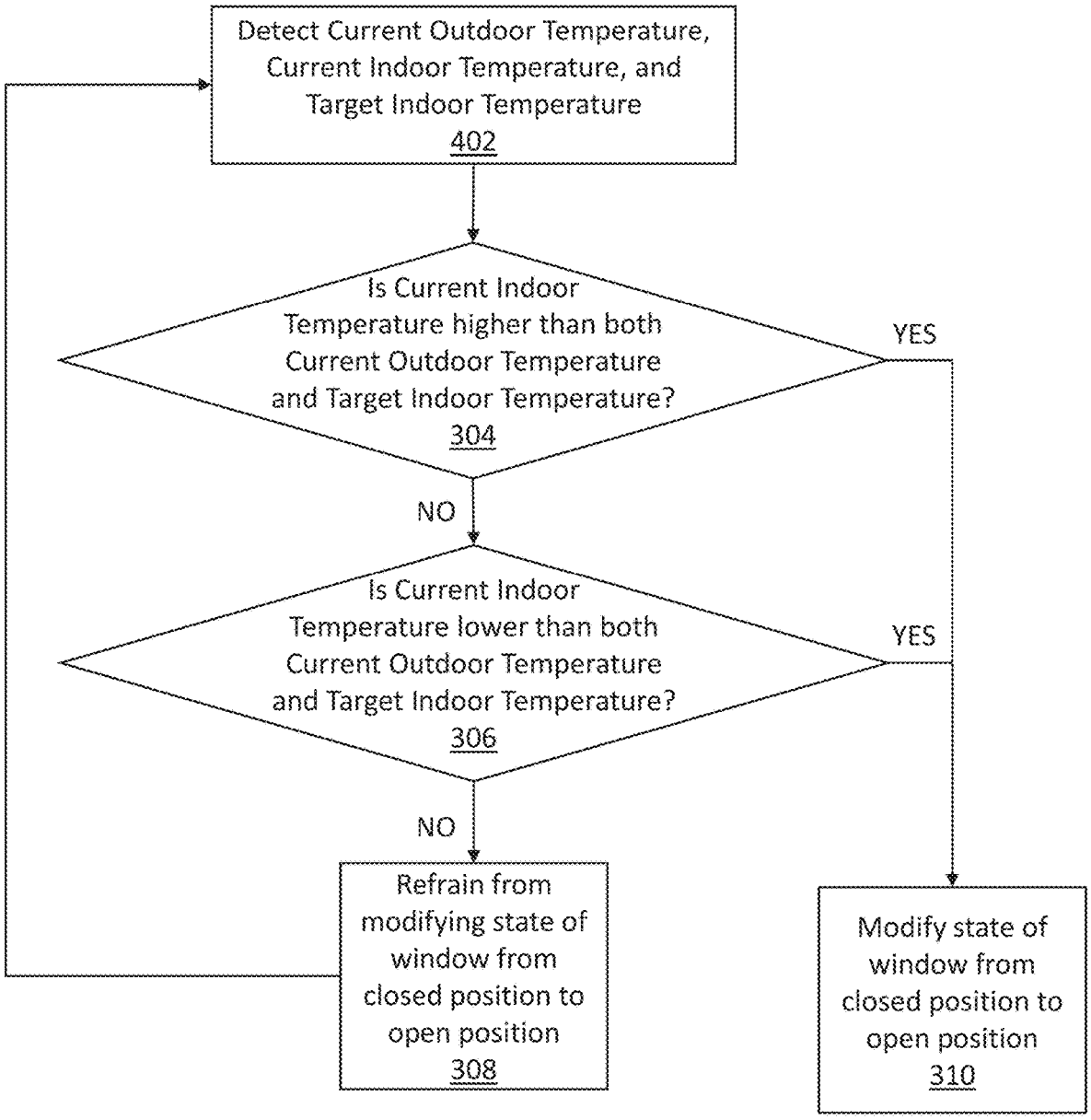
FIG. 3 illustrates an example set of operations for cooling and/or heating a structure including a window in accordance with one or more embodiments.

FIG. 3 illustrates an example set of operations for configuring a window in an open position in accordance with one or more embodiments. One or more operations illustrated in FIG. 3 may be modified, rearranged, or omitted all together. Accordingly, the particular sequence of operations illustrated in FIG. 3 should not be construed as limiting the scope of one or more embodiments.

A system may detect a current outdoor temperature at a location of a structure including at least one window, a current indoor temperature at the structure, and a target indoor temperature (Operation 302). In embodiments, detecting the current outdoor temperature may include reading a value measured by a sensor (e.g., a thermometer), disposed at the location, at a particular time (e.g., a current time). Alternatively or additionally, detecting the outdoor temperature may include receiving, from a third party weather monitoring service, a temperature value associated with the location at the particular time (e.g., the current time). In particular, the location may be identified by one or more of an address, a postal code, (e.g., a ZIP code), latitude and longitude coordinates, and/or any other geographical location identifier. In embodiments, detecting the current indoor temperature may include reading a sensor (e.g., a thermometer) that measures a temperature at a position in the interior of the structure, at a particular time (e.g., the current time). In embodiments, detecting the target indoor temperature may include receiving a target indoor temperature from a user via an interface. Alternatively, detecting the target indoor temperature can include determining, based on a current time of day and/or a particular day of week, a target indoor temperature recorded in a schedule associated with the system.

In some embodiments, the target indoor temperature may be directly specified by a user. That is, a user may enter a value for the target indoor temperature. The system may directly set the target indoor temperature based on the user input. In other embodiments, the system may determine the target indoor temperature range based on a current time and/or a current day of week. That is, a user may specify a schedule, where the target indoor temperature varies based on a time of day and/or a day of week. The system may store the schedule in a database or other storage location, and may determine a target indoor temperature based on comparing the current time of day and/or current day of week with the stored schedule.

In an embodiment, a target indoor temperature, defined for a system in cooling mode or a dual heating-cooling mode, corresponds to the lowest temperature that is tolerable to a user. In an example, the outdoor temperature varies from a high of 80° F. during the daytime to a low of 50° F. overnight. The system may be set in cooling mode with target indoor temperature of 60° F. 60° F. is the lowest temperature in the user's preferred temperature range for the inside of the user's home. Once the current indoor temperature reaches the target indoor temperature of 60° F., the lowest temperature tolerable by the user, the system closes the window. Closing the windows prevents the house from further cooling via air flow through the windows. However, it should be understood that the house may be further cooled lower than 60° F. even though the windows are closed due to other factors such as faulty seals, natural cooling through walls, etc. In some embodiments, the system may learn through a machine learning model that the house will likely be cooled by an additional amount subsequent to closing the windows through other cooling when the outside temperature is 50° F. Based on the expected amount of additional cooling the system may close the windows when the current indoor temperatures is still above the target indoor temperature by the expected amount. For example, if the expected amount of additional cooling is 2° F., the system may close the windows when the current indoor temperature reaches 62°.

The target indoor temperature, defined for a system in heating mode or a dual heating-cooling mode, may correspond to the highest temperature that is tolerable to a user. In an example, the outdoor temperature varies from a high of 80° F. during the daytime to a low of 45° F. overnight. A user may set the system in heating mode with target indoor temperature of 75° F. 75° F. is the highest temperature in the user's preferred temperature range for the inside of the user's home. Once the current indoor temperature reaches 75° F., the highest tolerable by the user, the system closes the window. Closing the windows prevents the house from further heating via air flow through the windows. However, it should be understood that the house may further heat to a temperature above 75° F. even though the windows are closed due to other factors such as faulty seals, natural heating through walls, etc.

In some embodiments, detecting one or more of the current outdoor temperature, the current indoor temperature, and/or the target indoor temperature may include periodically or continuously. The detecting may be performed in real-time or substantially in real time.

The system may determine whether the detected current indoor temperature, the detected outdoor temperature, and/or the target indoor temperature satisfy window opening criteria associated with a window mounted within an exterior wall of the structure. In some embodiments, each window of the structure may have independent window opening criteria. In other embodiments, two or more windows (e.g., including all windows) of the structure may be associated with a single window opening criteria.

In embodiments, window opening criteria may include one or more non-temperature weather criteria. For example, the window opening criteria may specify an air quality criteria (e.g., a maximum particulate amount permitted in the air), a humidity criteria (e.g., a maximum dew point), a wind speed and/or direction criteria (e.g., a maximum wind speed and/or a limitation on wind direction), and/or a precipitation criteria (e.g., a check for presence of precipitation in the area). There are many criteria, in addition to temperature, that may be considered when determining whether the system should cause a window to be configured in an open position.

In embodiments, the window-opening criteria may include one or more non-weather criteria. For example, window opening criteria may include a placement of the window in relation to the structure (e.g., for affecting airflow based on wind direction, for affecting an amount of direct sunlight received through the window, for restricting opening of windows that are accessible to persons outside the structure). As another example, window opening criteria may include one or more dimensions of the window (e.g., to avoid opening windows that would allow a person to pass through the open window). As an third example, the window opening criteria may include a current time (e.g., to avoid opening windows when no structure occupant is present).

The system may determine that window opening criteria are met by determining whether the detected current indoor temperature is higher than both the detected current outdoor temperature and the target indoor temperature (Operation 304).

If the system determines that the detected current indoor temperature is not higher than both the detected current outdoor temperature and the target indoor temperature (NO in Operation 304), the system may determine whether the detected current indoor temperature is lower than both the detected current outdoor temperature and the target indoor temperature (Operation 306).

If the system further determines that the detected current indoor temperature is not lower than both the detected current outdoor temperature and the target indoor temperature (NO in Operation 306), the system may refrain from modifying a state of the window from a closed position to an open position (Operation 308). That is, in response to determining, for example, that the current indoor temperature is higher than the target indoor temperature and lower than the detected current outdoor temperature, the system may refrain from modifying a state of the window from a closed position to an open position.

Alternatively, if the system determines either that the detected current indoor temperature is higher than both the detected current outdoor temperature and the target indoor temperature (YES in Operation 304) or that the detected current indoor temperature is lower than both the detected current outdoor temperature and the target indoor temperature (YES in Operation 306), the system may modify a state of the window from a closed position to an open position (Operation 310).

Operation 304 is intended for use in either a cooling-only mode or in a dual heating-cooling mode. Specifically, opening a window, when the current indoor temperature is higher than both the target indoor temperature and the current indoor temperature, would result in lowering the current indoor temperature. Operation 304 may be skipped in a heating-only mode, when the structure is not to be cooled using the windows-based HC system.

Operation 306 is intended for use in either a heating-only mode or in a dual heating-cooling mode. Specifically, opening a window, when the current indoor temperature is lower than both the target indoor temperature and the current indoor temperature, would result in increasing the current indoor temperature. Operation 306 may be skipped in a cooling only mode, when the structure is not to be heated using the windows-based HC system.

In some embodiments, the window may be configurable in only one open position (e.g., the window is either in an open position or a closed position). Accordingly, modifying the state of the window includes causing the window to move from the closed position to the open position.

In other embodiments, the window may be configurable in a plurality of open positions. For example, the window may be configurable in four open positions (e.g., 25% open, 50% open, 75% open, or 100% open). Accordingly, modifying the state of the window includes selecting an open position, from among the plurality of open positions, and causing the window to move from the closed position to the selected open position. The open position may be selected from among the plurality of open positions based on one or more of the detected outdoor temperature, the detected current indoor temperature, and the target indoor temperature. Modifying the state of the window from a closed position to an open position may include determining a temperature difference and selecting the open position based on the determined temperature difference. As particular examples, the open position may be selected based on a difference between the detected outdoor temperature and the detected current indoor temperature, a difference between the detected outdoor temperature and the target indoor temperature, or a difference between the detected current indoor temperature and the target indoor temperature.

In some embodiments, detecting the target indoor temperature in Operation 302 may include detecting a target indoor temperature range. That is, the target indoor temperature may indicate a range of temperatures at which the user is satisfied with the indoor temperature. The target indoor temperature range may be defined by at least a lower bound temperature and an upper bound temperature. As a specific example, the target indoor temperature range may be defined by a lower bound of 65° F. and an upper bound of 75° F., such that a user is satisfied if the indoor temperature is anywhere within the range of 65° F.-75° F.

In some embodiments, the target indoor temperature range may be directly specified by a user. That is, a user may enter a value for both the lower bound temperature and the upper bound temperature. The system may directly set the target indoor temperature range based on the user input. In other embodiments, the system may determine the target indoor temperature range (e.g., a lower bound temperature and an upper bound temperature) based on a current time and/or a current day of week. That is, a user may specify a schedule, where the lower bound temperature and/or upper bound temperature vary based on a time of day and/or a day of week. The system may store the schedule in a database or other storage location, and may determine a target indoor temperature range based on comparing the current time of day and/or current day of week with the stored schedule.

When the system receives a target indoor temperature range, the window opening criteria may also be defined slightly differently. For example, the window opening criteria may be that the current indoor temperature is lower than the current outdoor temperature, the upper bound temperature value, and the lower bound temperature value. Additionally or alternatively, the window opening criteria may be satisfied when the current indoor temperature is higher than the current outdoor temperature, the upper bound temperature value, and the lower bound temperature value. The is the window opening criteria may be satisfied when the current indoor temperature is outside of the target indoor temperature range, and the current outdoor temperature is in the same "direction" as the target indoor temperature range relative to the current indoor temperature (e.g., if the current indoor temperature is higher than the upper bound temperature and lower bound temperature, then the current indoor temperature is also higher than the current outdoor temperature; if the current indoor temperature is lower than the upper bound temperature and lower bound temperature, then the current indoor temperature is also lower than the current outdoor temperature).

In some embodiments, the system may further be configured to modify a state of the window from an open position to a closed position. For example, the system may modify the state of the window in response to determining that the current indoor temperature matches the target indoor temperature. As another example, the system may periodical or continuously monitor the window opening criteria, and may modify the state of the window responsive to determining that the window opening criteria are no longer met.

4.2 Selecting a HC System Based on a Temperature Differential

Figure 4:
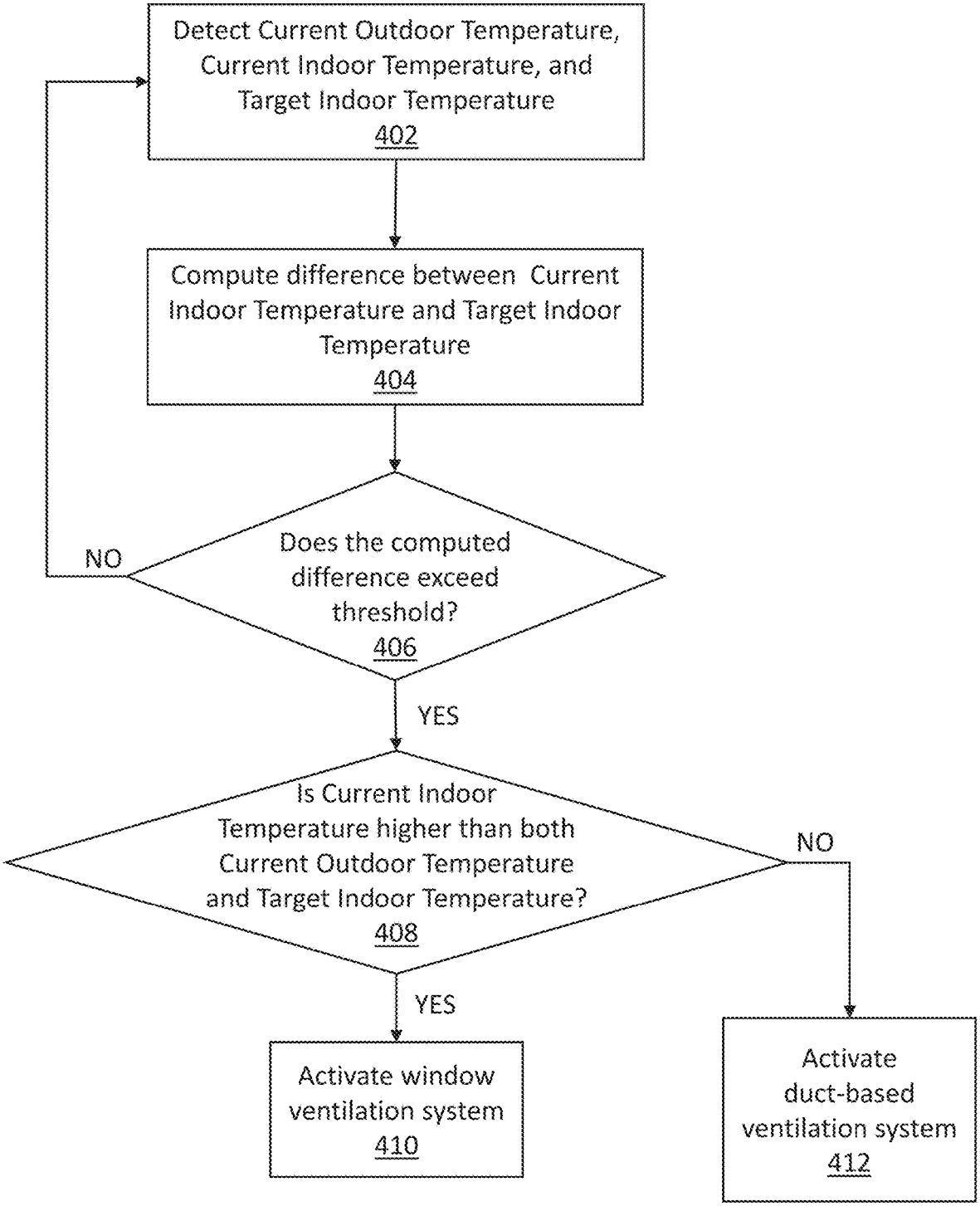
FIG. 4 illustrates another example set of operations for cooling and/or heating a structure including a window in accordance with one or more embodiments.

FIG. 4 illustrates an example set of operations for configuring a window in an open position in accordance with one or more embodiments. One or more operations illustrated in FIG. 4 may be modified, rearranged, or omitted all together. Accordingly, the particular sequence of operations illustrated in FIG. 4 should not be construed as limiting the scope of one or more embodiments.

A system may detect a current outdoor temperature at a location of a structure including at least one window, a current indoor temperature at the structure, and a target indoor temperature (Operation 402). In embodiments, detecting the current outdoor temperature may include reading a value measured by a sensor (e.g., a thermometer), disposed at the location, at a particular time (e.g., a current time). Alternatively or additionally, detecting the outdoor temperature may include receiving, from a third party weather monitoring service, a temperature value associated with the location at the particular time (e.g., the current time). In particular, the location may be identified by one or more of an address, a postal code, (e.g., a ZIP code), latitude and longitude coordinates, and/or any other geographical location identifier. In embodiments, detecting a current indoor temperature may include reading a sensor (e.g., a thermometer) that measures a temperature, at a position in the interior of the structure, at the particular time (e.g., the current time). In embodiments, detecting a target indoor temperature may include receiving a target indoor temperature from a user via an interface. Alternatively, detecting a target indoor temperature can include determining, based on a current time of day and/or a particular day of week, a target indoor temperature recorded in a schedule associated with the system.

In some embodiments, detecting the current outdoor temperature, the current indoor temperature, and the target indoor temperature may include periodically or continuously monitoring the current indoor temperature and/or the outdoor temperature. The monitoring may be performed in real-time or substantially in real time.

The system may compute a difference between the detected current indoor temperature and the target indoor temperature (Operation 404). In some embodiments, the difference is computed as an absolute value, such that the difference is greater than zero.

The system may determine if the computed difference between the current indoor temperature and the target indoor temperature exceeds a threshold value (Operation 406). The threshold value may be any value that is greater than zero. For example, the threshold value may be 0.1, 1, 10, or any other non-zero value. In some embodiments, the threshold may be a constant value. In other embodiments, the threshold value may be based on one or more of the current indoor temperature and the target indoor temperature.

If the computed difference does not exceed the threshold (NO in Operation 406), the system may return to Operation 402. That is, the system may continue to monitor current outdoor temperature, current indoor temperature, and target indoor temperature while refraining from activating any HC system.

If the computed difference exceeds the threshold (YES in Operation 406), The system may determine whether the detected current indoor temperature, the detected current outdoor temperature, and the target indoor temperature satisfy window opening criteria associated with a window mounted within an exterior wall of the structure. In some embodiments, each window of the structure may have independent window opening criteria. In other embodiments, two or more windows (e.g., including all windows) of the structure may be associated with a single window opening criteria.

In embodiments, window opening criteria may include one or more non-temperature weather criteria. For example, the window opening criteria may specify an air quality criteria (e.g., a maximum particulate amount permitted in the air), a humidity criteria (e.g., a maximum dew point), a wind speed and/or direction criteria (e.g., a maximum wind speed and/or a limitation on wind direction), and/or a precipitation criteria (e.g., a check for presence of precipitation in the area). There are many criteria, in addition to temperature, that may be considered when determining whether the system should cause a window to be configured in an open position.

In embodiments, the window-opening criteria may include one or more non-weather criteria. For example, window opening criteria may include a placement of the window in relation to the structure (e.g., for affecting airflow based on wind direction, for affecting an amount of direct sunlight received through the window, for restricting opening of windows that are accessible to persons outside the structure). As another example, window opening criteria may include one or more dimensions of the window (e.g., to avoid opening windows that would allow a person to pass through the open window). As an third example, the window opening criteria may include a current time (e.g., to avoid opening windows when no structure occupant is present).

The system may determine whether window opening criteria are met by determining whether the current indoor temperature is higher than both the current outdoor temperature and the target indoor temperature (Operation 408). If the current indoor temperature is higher than both the current outdoor temperature and the target indoor temperature (YES in Operation 408), the system may activate a window HC system (Operation 410). That is, the system may be used in a cooling-only mode. Specifically, opening a window, when the current indoor temperature is higher than both the target indoor temperature and the current indoor temperature, would result in lowering the current indoor temperature.

Activating a window HC system may include modifying a state of the window from a closed position to an open position. In some embodiments, the window may be configurable in only one open position (e.g., the window is either in an open position or a closed position). Accordingly, modifying the state of the window includes causing the window to move from the closed position to the open position.

In other embodiments, the window may be configurable in a plurality of open positions. For example, the window may be configurable in four open positions (e.g., 25% open, 50% open, 75% open, or 100% open). Accordingly, modifying the state of the window includes selecting an open position, from among the plurality of open positions, and causing the window to move from the closed position to the selected open position. The open position may be selected from among the plurality of open positions based on one or more of the detected outdoor temperature, the detected current indoor temperature, and the target indoor temperature. As particular examples, the open position may be selected based on a difference between the detected outdoor temperature and the detected current indoor temperature, a difference between the detected outdoor temperature and the target indoor temperature, or a difference between the detected current indoor temperature and the target indoor temperature.

In embodiments, activating the window HC system may further include activating a fan disposed proximate to the window and positioned to encourage airflow through the window. Activating the fan may include selecting one or more of a fan speed and/or a fan direction.

In some embodiments, the system may further be configured to deactivate the window HC system. Deactivating the window HC system may include modifying a state of the window from an open position to a closed position and/or deactivating a fan disposed proximate to the window. For example, the system may deactivate the window HC system in response to determining that the current indoor temperature matches the target indoor temperature. As another example, the system may periodical or continuously monitor the window opening criteria, and may deactivate the window HC system responsive to determining that the window opening criteria are no longer met.

If the current indoor temperature is not higher than both the current outdoor temperature and the target indoor temperature (NO in Operation 408), the system may activate a centralized, duct-based HC system (Operation 412). That is, the duct-based HC system may be activated in response to determining that the current indoor temperature is between the current outdoor temperature and the target indoor temperature. Alternatively, the duct-based HC system may be activated in response to determining that the current indoor temperature is (a) equivalent to the current outdoor temperature and (b) different than the target indoor temperature. The duct-based HC system may also be activated in response to determining that the current indoor temperature is lower than the current outdoor temperature (e.g., to activate a heating mode of the duct based HC system). Operating the duct-based HC system may include activating one or more of a furnace, a heat pump, an air conditioner, and/or a centralized ventilation fan (e.g., a house fan).

In some embodiments, the system may further be configured to deactivate the duct-based HC system. Deactivating the duct-based HC system may include deactivating one or more of a furnace, a heat pump, an air conditioner, and/or a centralized ventilation fan (e.g., a house fan). For example, the system may deactivate the duct-based HC system in response to determining that the current indoor temperature matches the target indoor temperature. As another example, the system may periodical or continuously monitor the window opening criteria, and may deactivate the duct-based HC system responsive to determining that the window opening criteria are met.

In an embodiment, the HC system may use a combination of a window-based subsystem and a ducts-based subsystem to cool (or heat) a structure. The HC system may use the window-based subsystem and the ducts-based subsystem concurrently at the same time, or during separate respective time intervals. The HC system may initially use the window-based subsystem by opening the windows to allow natural cooling, and later, close the windows and use the ducts-based subsystem. In an example, a current indoor temperature is 85° F., a current outdoor temperature is 75° F., and a target indoor temperature is 68° F. When the HC system is activated in a cooling mode, the HC system determines that the window-based subsystem would be effective in lowering the current indoor temperature. Accordingly, the HC system opens the windows to allow cooler outside air to flow into the structure. Additionally, opening the windows allows hot inside air to flow out of the structure. After a certain period of time, the HC system determines that both the current indoor temperature and the current outdoor temperature are at 74° F. However, the target indoor temperature is still at 68° F. Determining that the window-based subsystem can no longer cool the current indoor temperature from 74° F. to the target indoor temperature of 68° F., the HC system closes the windows, and activates the ducts-based HC subsystem. The ducts-based HC subsystem then blows cool air through the structure until the current indoor temperature reaches 68° F. The HC system may also transition from using the window-based subsystem to the duct-based subsystem when the current indoor temperature is within a threshold distance of the current outdoor temperature (e.g., difference is less than or equal to 3° F.). The HC system transitions from the window-based subsystem to the ducts-based subsystem based on the current effectiveness of the window-based subsystem to modify the current indoor temperature to reach the target indoor temperature.

4.3 Controlling Ventilation Based on Window Position

A system may synchronize activation and/or deactivation of a HC device with opening and/or closing of a window associated with the HC device. One or more operations described for synchronizing activation and/or deactivation of a HC device with opening and/or closing of a window as described below may be modified, rearranged, or omitted all together. Accordingly, the particular sequence of operations should not be construed as limiting the scope of one or more embodiments.

The system may synchronize opening a window with activating a HC device. For example, the system may detect, at a first time, that a window is configured in an open position. In some embodiments, detecting that a window is in an open position may include determining that a window is in an open position based on a sensor (e.g., a proximity sensor) that determines whether a movable portion of the window is separated from the window frame. In some embodiments, detecting that a window is in an open position may comprise receiving a signal that causes the system to modify a position of the window from a closed position to an open position.

Responsive to the determination that the window is in an open position, the system may activate the HC device. In some embodiments, the HC device is a fan positioned to encourage airflow through the window. In embodiments, activating the fan includes one or more of causing the fan to turn on, selecting a fan speed, and/or selecting a fan direction.

The system may synchronize closing a window with deactivating a HC device. For example, the system may detect, at a first time, that a window is configured in a closed position. In some embodiments, detecting that a window is in a closed position may include determining that a window is in a closed position based on a sensor (e.g., a proximity sensor) that determines whether a movable portion of the window is separated from the window frame. In some embodiments, detecting that a window is in a closed position may comprise receiving a signal that causes the system to modify a position of the window from an open position to a closed position.

Responsive to the determination that the window is in the closed position, the system may deactivate the HC device. In some embodiments, the HC device is a fan positioned to encourage airflow through the window. In embodiments, deactivating the fan includes causing the fan to turn off.

4.4 Controlling a Window State Based on Temperature Forecasting

A system may control a state of a window based oat least in part on forecast temperatures and/or forecast temperature trends. One or more operations described for controlling a state of a window based oat least in part on forecast temperatures and/or forecast temperature trends as described below may be modified, rearranged, or omitted all together. Accordingly, the particular sequence of operations should not be construed as limiting the scope of one or more embodiments.

A system may obtain predicted outdoor temperature values at a location of a structure that includes a window. In embodiments, the predicted outdoor temperature values may be obtained from a third party weather forecasting service. The values may be provided for a specific region or location based on one or more of an address, a postal code, (e.g., a ZIP code), latitude and longitude coordinates, and/or any other geographical location identifier. The predicted values may be based on one or more weather forecasts for the location or region. The predicted outdoor temperature values may include predictions for a particular time period (e.g., 24 hours), with predicted values assigned for regular intervals within that time period (e.g., a predicted value associated with each hour in the 24 hour period). A particular example is show in FIG. 5, which illustrates a predicted temperature line 502, including hourly predicted temperature values 504.

Figure 5:
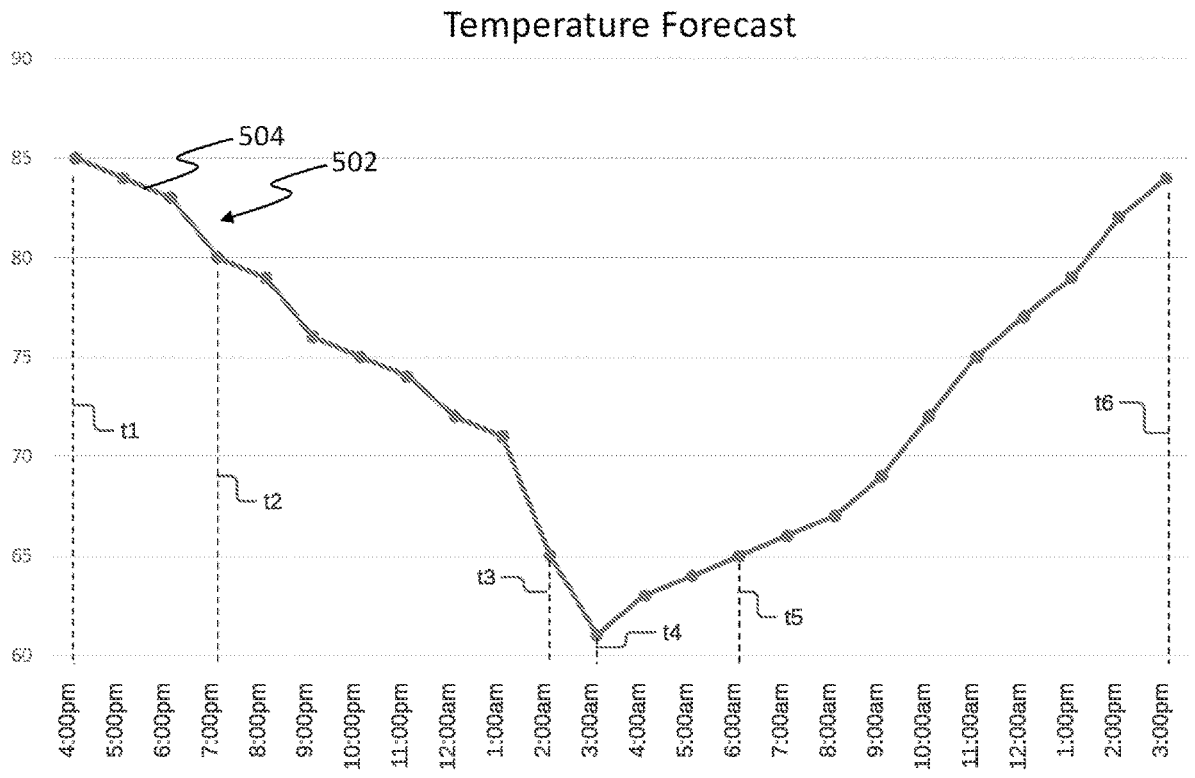
FIG. 5 illustrates predicted temperature data set for use in cooling and/or heating a structure including a window in accordance with one or more embodiments.

The system may identify a cooling period of time during which the predicted temperature values are decreasing. Initially, the system may determine a period of time during which predicted temperatures are decreasing. The system may then identify a subset of the determined period as the cooling period. In particular, the system may use one or more additional criteria to determine the cooling period. For example, the criteria may include a maximum temperature and/or a minimum temperature at which the window should be open. As another example, the criteria may include determining that the predicted outdoor temperature and the target indoor temperature are both lower than the current indoor temperature. As a particular example, FIG. 5 shows that temperatures are decreasing from a time t1 (4:00 PM) through a time t4 (3:00 AM). The system may determine a cooling period to be a subset of the time period t1 to t4 (4:00 PM to 3:00 AM). Criteria for the cooling period may also include a maximum temperature of 80° F. and a minimum temperature of 65° F. Accordingly, the cooling period may be identified as the subset of the temperature decreasing period from a time t2 at which the predicted outdoor temperature drops below the identified maximum temperature (7:00 PM) to a time t3 at which the predicted outdoor temperature drops below the identified minimum temperature (2:00 AM). Thus, the cooling period is identified as the time period t2 to t3 (7:00 PM to 2:00 AM).

The system may determine that the structure is to be cooled using a window-based HC system by configuring the window to an open position prior to the identified cooling period. For example, the system may configure the window to an open position immediately prior to the cooling period beginning at t2 (e.g., at 7:00 PM in the example shown in FIG. 5). Alternatively, the window may be configured to an open position at any time during the temperature decreasing period prior to the cooling period (e.g., any time between t1 and t2; 4:00 PM and 7:00 PM in the example shown in FIG. 5). Configuring the window to an open position may comprise, for example, transmitting an instruction to a window control unit for causing the window to be configured in the open position.

The system may identify a warming period of time during which the predicted temperature values are increasing. Initially, the system may determine a period of time during which predicted temperatures are increasing. The system may then identify a subset of the determined period as the warming period. In particular, the system may use one or more additional criteria to determine the cooling period. For example, the criteria may include a threshold temperature. As a particular example, FIG. 5 shows that temperatures are increasing from a time t4 (3:00 AM) through a time t6 (3:00 PM). The system may determine a warming period to be a subset of the time period t4 to t6 (3:00 AM to 3:00 PM). Criteria for the warming period may also include a threshold temperature of 65° F. Accordingly, the cooling period may be identified as the subset of the temperature increasing period from a time t5 at which the predicted outdoor temperature exceeds the threshold temperature (6:00 AM) to a time t6 at which the temperature increasing period ends (3:00 PM). Thus, the warming period is identified as the time period t5 to t6 (6:00 AM to 3:00 PM).

As part of the cooling methodology, the system may determine that the window should be closed prior to the warming period. Accordingly, prior to the warming period (e.g., prior to t5; 6:00 AM as shown in FIG. 5), the system may cause the window to close. For example, the system may cause the window to close immediately prior to time t5 (e.g., at time t5). Alternatively, the system may cause the window to close any time subsequent to an end of the cooling period and prior to a beginning of the warming period (e.g., at any time between time t3 and time t5). In embodiments, a time at which the window is closed may be based on one or more of a predicted outdoor temperature, a current indoor temperature, and a target indoor temperature.

5. Miscellaneous; Extensions

Embodiments are directed to a system with one or more devices that include a hardware processor and that are configured to perform any of the operations described herein and/or recited in any of the claims below.

In an embodiment, a non-transitory computer readable storage medium comprises instructions which, when executed by one or more hardware processors, causes performance of any of the operations described herein and/or recited in any of the claims.

Any combination of the features and functionalities described herein may be used in accordance with one or more embodiments. In the foregoing specification, embodiments have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction.

6. Hardware Overview

According to one embodiment, the techniques described herein are implemented by one or more special-purpose computing devices. The special-purpose computing devices may be hard-wired to perform the techniques, or may include digital electronic devices such as one or more application-specific integrated circuits (ASICs), field programmable gate arrays (FPGAs), or network processing units (NPUs) that are persistently programmed to perform the techniques, or may include one or more general purpose hardware processors programmed to perform the techniques pursuant to program instructions in firmware, memory, other storage, or a combination. Such special-purpose computing devices may also combine custom hard-wired logic, ASICs, FPGAs, or NPUs with custom programming to accomplish the techniques. The special-purpose computing devices may be desktop computer systems, portable computer systems, handheld devices, networking devices or any other device that incorporates hard-wired and/or program logic to implement the techniques.

Figure 6:
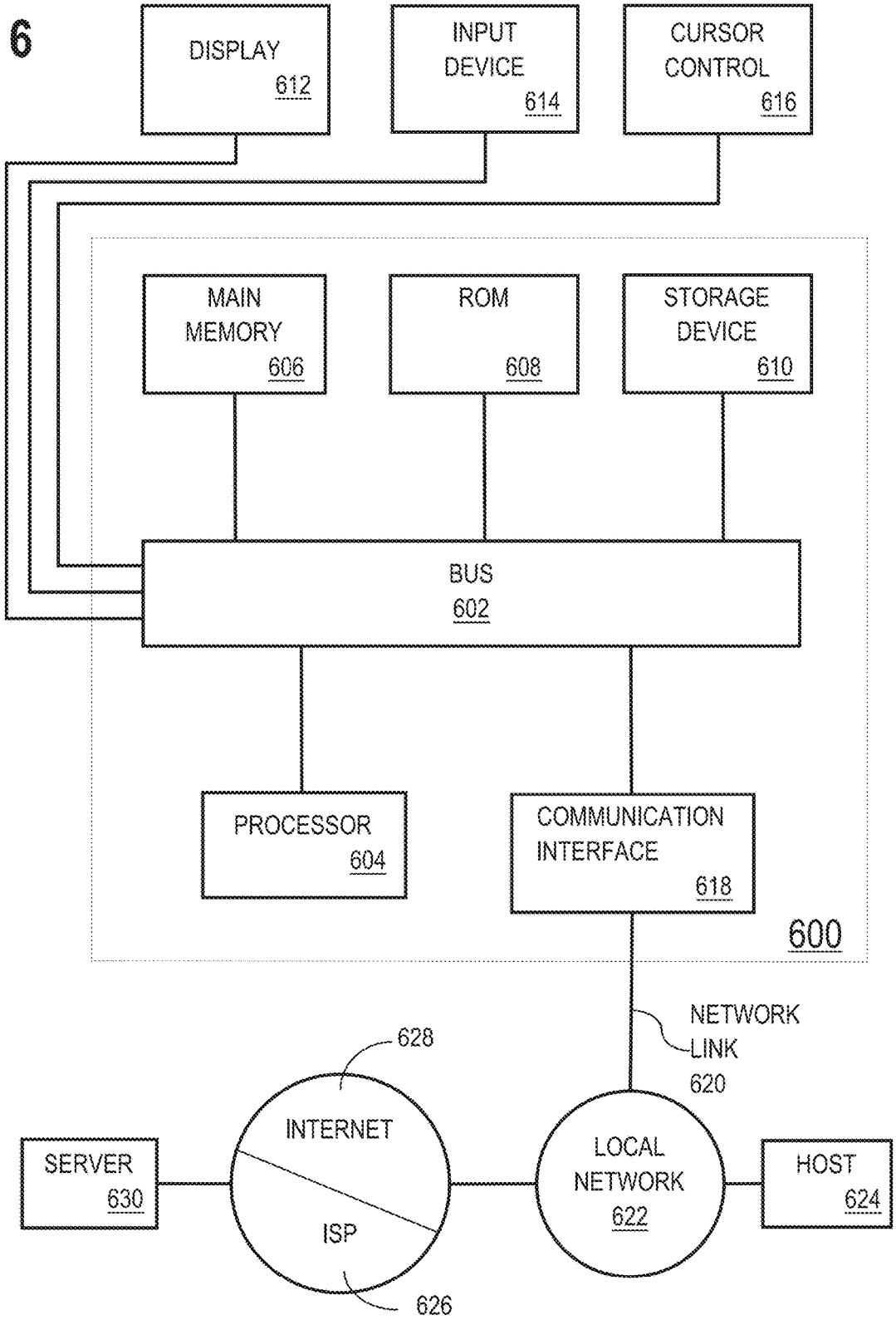
FIG. 6 shows a block diagram that illustrates a computer system in accordance with one or more embodiments.

For example, FIG. 6 is a block diagram that illustrates a computer system 600 upon which an embodiment of the invention may be implemented. Computer system 600 includes a bus 602 or other communication mechanism for communicating information, and a hardware processor 604 coupled with bus 602 for processing information. Hardware processor 604 may be, for example, a general purpose microprocessor.

Computer system 600 also includes a main memory 606, such as a random access memory (RAM) or other dynamic storage device, coupled to bus 602 for storing information and instructions to be executed by processor 604. Main memory 606 also may be used for storing temporary variables or other intermediate information during execution of instructions to be executed by processor 604. Such instructions, when stored in non-transitory storage media accessible to processor 604, render computer system 600 into a special-purpose machine that is customized to perform the operations specified in the instructions.

Computer system 600 further includes a read only memory (ROM) 608 or other static storage device coupled to bus 602 for storing static information and instructions for processor 604. A storage device 610, such as a magnetic disk or optical disk, is provided and coupled to bus 602 for storing information and instructions.

Computer system 600 may be coupled via bus 602 to a display 612, such as a cathode ray tube (CRT), for displaying information to a computer user. An input device 614, including alphanumeric and other keys, is coupled to bus 602 for communicating information and command selections to processor 604. Another type of user input device is cursor control 616, such as a mouse, a trackball, or cursor direction keys for communicating direction information and command selections to processor 604 and for controlling cursor movement on display 612. This input device typically has two degrees of freedom in two axes, a first axis (e.g., x) and a second axis (e.g., y), that allows the device to specify positions in a plane.

Computer system 600 may implement the techniques described herein using customized hard-wired logic, one or more ASICs or FPGAs, firmware and/or program logic which in combination with the computer system causes or programs computer system 600 to be a special-purpose machine. According to one embodiment, the techniques herein are performed by computer system 600 in response to processor 604 executing one or more sequences of one or more instructions contained in main memory 606. Such instructions may be read into main memory 606 from another storage medium, such as storage device 610. Execution of the sequences of instructions contained in main memory 606 causes processor 604 to perform the process steps described herein. In alternative embodiments, hard-wired circuitry may be used in place of or in combination with software instructions.

The term "storage media" as used herein refers to any non-transitory media that store data and/or instructions that cause a machine to operate in a specific fashion. Such storage media may comprise non-volatile media and/or volatile media. Non-volatile media includes, for example, optical or magnetic disks, such as storage device 610. Volatile media includes dynamic memory, such as main memory 606. Common forms of storage media include, for example, a floppy disk, a flexible disk, hard disk, solid state drive, magnetic tape, or any other magnetic data storage medium, a CD-ROM, any other optical data storage medium, any physical medium with patterns of holes, a RAM, a PROM, and EPROM, a FLASH-EPROM, NVRAM, any other memory chip or cartridge, content-addressable memory (CAM), and ternary content-addressable memory (TCAM).

Storage media is distinct from but may be used in conjunction with transmission media. Transmission media participates in transferring information between storage media. For example, transmission media includes coaxial cables, copper wire and fiber optics, including the wires that comprise bus 602. Transmission media can also take the form of acoustic or light waves, such as those generated during radio-wave and infra-red data communications.

Various forms of media may be involved in carrying one or more sequences of one or more instructions to processor 604 for execution. For example, the instructions may initially be carried on a magnetic disk or solid state drive of a remote computer. The remote computer can load the instructions into its dynamic memory and send the instructions over a telephone line using a modem. A modem local to computer system 600 can receive the data on the telephone line and use an infra-red transmitter to convert the data to an infra-red signal. An infra-red detector can receive the data carried in the infra-red signal and appropriate circuitry can place the data on bus 602. Bus 602 carries the data to main memory 606, from which processor 604 retrieves and executes the instructions. The instructions received by main memory 606 may optionally be stored on storage device 610 either before or after execution by processor 604.

Computer system 600 also includes a communication interface 618 coupled to bus 602. Communication interface 618 provides a two-way data communication coupling to a network link 620 that is connected to a local network 622. For example, communication interface 618 may be an integrated services digital network (ISDN) card, cable modem, satellite modem, or a modem to provide a data communication connection to a corresponding type of telephone line. As another example, communication interface 618 may be a local area network (LAN) card to provide a data communication connection to a compatible LAN. Wireless links may also be implemented. In any such implementation, communication interface 618 sends and receives electrical, electromagnetic or optical signals that carry digital data streams representing various types of information.

Network link 620 typically provides data communication through one or more networks to other data devices. For example, network link 620 may provide a connection through local network 622 to a host computer 624 or to data equipment operated by an Internet Service Provider (ISP) 626. ISP 626 in turn provides data communication services through the world wide packet data communication network now commonly referred to as the "Internet" 628. Local network 622 and Internet 628 both use electrical, electromagnetic or optical signals that carry digital data streams. The signals through the various networks and the signals on network link 620 and through communication interface 618, which carry the digital data to and from computer system 600, are example forms of transmission media.

Computer system 600 can send messages and receive data, including program code, through the network(s), network link 620 and communication interface 618. In the Internet example, a server 660 might transmit a requested code for an application program through Internet 628, ISP 626, local network 622 and communication interface 618.

The received code may be executed by processor 604 as it is received, and/or stored in storage device 610, or other non-volatile storage for later execution.

In the foregoing specification, embodiments of the invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction.

What is claimed is:

1. One or more non-transitory computer readable media comprising instructions which, when executed by one or more hardware processors, causes performance of operations comprising:

detecting a current outdoor temperature at a location of a structure, the structure comprising a window;

detecting a current indoor temperature inside the structure;

detecting a target indoor temperature for the structure;

based on the current outdoor temperature, the current indoor temperature, and the target indoor temperature, determining that a window opening criteria is met;

responsive to determining that the window opening criteria has been met: instructing a window control mechanism to modify a state of the window from (a) a closed position that prevents airflow through the window to (b) an open position that allows for airflow through the window.

2. The medium of claim 1, wherein determining that the window opening criteria is met comprises determining that the current indoor temperature is higher than both the current outdoor temperature and the target indoor temperature.

3. The medium of claim 1, wherein determining that the window opening criteria is met comprises determining that the current indoor temperature is lower than both the current outdoor temperature and the target indoor temperature.

4. The media of claim 1, wherein the operations further comprise:

determining a temperature difference between the current indoor temperature and the target indoor temperature;

based on the temperature difference: selecting the open position from a plurality of open positions for the window, wherein a respective rate of the airflow through the window is different for each of the plurality of open positions.

5. The media of claim 1, wherein the operations further comprise:

determining a temperature difference between the current indoor temperature and the target indoor temperature;

based on the temperature difference: activating a ducts-based Heating Cooling (HC) system by configuring a Heating, Ventilation, and Air Conditioning (HVAC) unit to blow heated air or cooled air into the structure through ducts and vents within the structure.

6. The media of claim 1, wherein detecting the current outdoor temperature comprises obtaining the current outdoor temperature for a zip code or city, that includes the location, from a server over a network.

7. The media of claim 1, wherein the operations further comprise:

determining a temperature difference between the current indoor temperature and the target indoor temperature;

based on the temperature difference: activating a fan positioned to blow air through the window.

8. The media of claim 1, wherein the operations further comprise (a) activating a fan, positioned to blow air through the window, when the window is configured in the open position and (b) deactivating the fan when the window is configured in the closed position.

9. The media of claim 1, wherein determining that the window opening criteria is met is further based on a placement of the window in relation to the structure.

10. The media of claim 1, wherein determining that the window opening criteria is met is further based on one or more dimensions of the window.

11. The media of claim 1, wherein determining that the window opening criteria is met is further based on a current time.

12. The media of claim 1, wherein the structure comprises a plurality of windows, and wherein each window, of the plurality of windows, is controlled independently to open or close each window regardless of whether other windows are being opened or closed.

13. The media of claim 1, wherein the operations further comprise: modifying, by the window control mechanism, the state of the window from the closed position to the open position.

14. The media of claim 1, wherein the operations further comprise:

instructing the system component to modify the state of the window from (a) the open position that allows for airflow through the window to (b) the closed position that prevents airflow through the window.

15. One or more non-transitory computer readable media comprising instructions which, when executed by one or more hardware processors, causes performance of operations comprising:

detecting at a first time:

a current outdoor temperature at a location of a structure comprising a window;

a current indoor temperature inside the structure;

a target indoor temperature for the structure;

computing a difference between the current indoor temperature and the target indoor temperature;

determining that the difference between the current indoor temperature and the target indoor temperature meets a threshold value;

responsive to determining that the difference between the current indoor temperature and the target indoor temperature meets a threshold value activating only one of:

a window-based Heating Cooling (HC) system or a ducts-based HC system to result in modification of the current indoor temperature;

wherein the window-based HC system heats or cools the structure by configuring a window in an open position to allow for outdoor air to flow into the structure through the window;

wherein the ducts-based HC system heats or cools the structure by configuring an HVAC unit to blow air into the structure through ducts and vents within the structure;

wherein activating only one of the window-based HC system or the ducts-based HC system comprises:

activating only the window-based HC system when the current indoor temperature is either (a) lower than both the current outdoor temperature and the target indoor temperature or (b) the current indoor temperature is higher than both the current outdoor temperature and the target indoor temperature;

activating only the ducts-based HC system when the current indoor temperature is between the current outdoor temperature and the target indoor temperature; and activating only the ducts-based HC system when the current indoor temperature is (a) equivalent to the current outdoor temperature and (b) different than the target indoor temperature.

16. The media of claim 15, window-based HC system is activated based on further on determining that the outdoor air quality at the location satisfies air quality criteria.

17. One or more non-transitory computer readable media comprising instructions which, when executed by one or more hardware processors, causes performance of operations comprising:

detecting at a first time:

a current outdoor temperature at a location of a structure comprising a window;

a current indoor temperature inside the structure;

a target indoor temperature range for the structure, the target indoor temperature range being defined by an upper bound temperature value and a lower bound temperature value;

based on the current outdoor temperature, the current indoor temperature, and the target indoor temperature range, determining that a window opening criteria has been met, wherein the window opening criteria is met when:

(a) the current indoor temperature is lower than the current outdoor temperature and the lower bound temperature value; or (b) the current indoor temperature is higher than both the current outdoor temperature, and the upper bound temperature value;

responsive to determining that the window opening criteria has been met: instructing a window control mechanism to modify a state of the window from (a) a closed position that prevents airflow through the window to (b) an open position that allows for airflow through the window.

18. The media of claim 17, wherein the target indoor temperature range is determined based on one or more of: a current time or a current day of a week.

19. The media of claim 17, wherein subsequent to the state of the window being modified from the closed position to the open position, the operations further comprise:

based on the current outdoor temperature, the current indoor temperature, and the target indoor temperature range, determining that a window closing criteria has been met, wherein the window closing criteria is met when the current indoor temperature is:

(a) the current indoor temperature is higher than the current outdoor temperature and lower than the lower bound temperature; or (b) the current indoor temperature is lower than both the current outdoor temperature, and higher than the upper bound temperature value;

responsive to determining that the window closing criteria has been met: instructing the window control mechanism to modify the state of the window from (a) the open position that allows for airflow through the window to (b) the closed position that prevents airflow through the window.

* * * * *